United States Patent [19]

Briones

[11] Patent Number: 4,556,272

[45] Date of Patent: Dec. 3, 1985

[54] FLAT CABLE CONNECTOR

[75] Inventor: Francisco R. Briones, Markham, Canada

[73] Assignee: Allied Corporation, Morris Township, Morris County, N.J.

[21] Appl. No.: 309,546

[22] Filed: Oct. 7, 1981

[51] Int. Cl.[4] ..... H01R 4/24

[52] U.S. Cl. ..... 339/99 R; 339/103 M; 339/147 R

[58] Field of Search ..... 339/97 R, 97 P, 98, 339/99 R, 103 M, 147 R, 147 P; 29/881, 882, 884

[56] References Cited

U.S. PATENT DOCUMENTS

| | | | |
|---|---|---|---|
| 2,999,998 | 9/1961 | Cole | 339/64 R |
| 3,825,874 | 7/1974 | Peverill | 339/147 R |
| 3,990,767 | 11/1976 | Narozny | 339/198 R |
| 4,215,326 | 7/1980 | Hollyday | 339/147 R |
| 4,351,582 | 9/1982 | Emerson et al. | 339/97 P |
| 4,418,977 | 12/1983 | O'Shea, Jr. | 339/99 R |

FOREIGN PATENT DOCUMENTS

| | | | |
|---|---|---|---|
| WO81/01347 | 5/1981 | PCT Int'l Appl. | 339/99 R |
| 2033676 | 5/1980 | United Kingdom | 339/99 R |

OTHER PUBLICATIONS

13th Annual Connector Symposium, Philadelphia, PA, Oct. 8–9, 1980, "A Mass-Termination, Filtered Connector for RS-232-C Circuits," by: Brian F. Whittaker.

*Primary Examiner*—Gil Weidenfeld
*Assistant Examiner*—Gary F. Paumen
*Attorney, Agent, or Firm*—Roger H. Criss

[57] ABSTRACT

A connector for electrically connecting the conductors of a flat ribbon-type cable arranged in a first configuration to the contacts of a standard connector arranged in a second configuration comprises a housing receiving a plurality of substantially identical contacts. Each contact comprises a conductor terminating end connected to a contact mating end by a deformable intermediate portion. The contacts are received within the housing, and the contact mating ends thereof are held in the first configuration for mating with standard connector. The conductor terminating ends of the conductor are formed to the second configuration by installing a cover to the connector, the cover having a plurality of tapered contact forming apertures, each guiding a respective conductor terminating end therethrough.

9 Claims, 6 Drawing Figures

FIG. 1
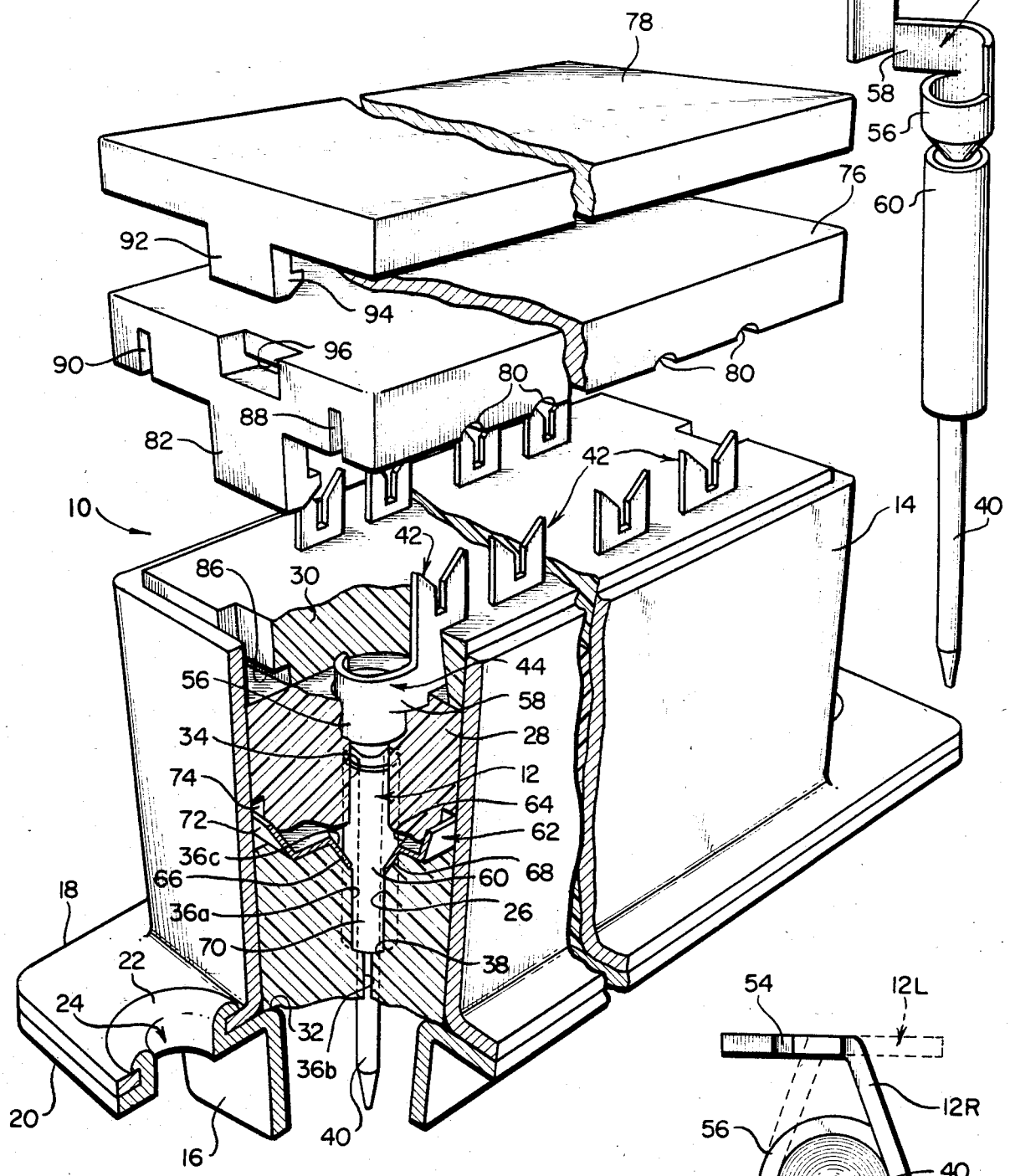
FIG. 2
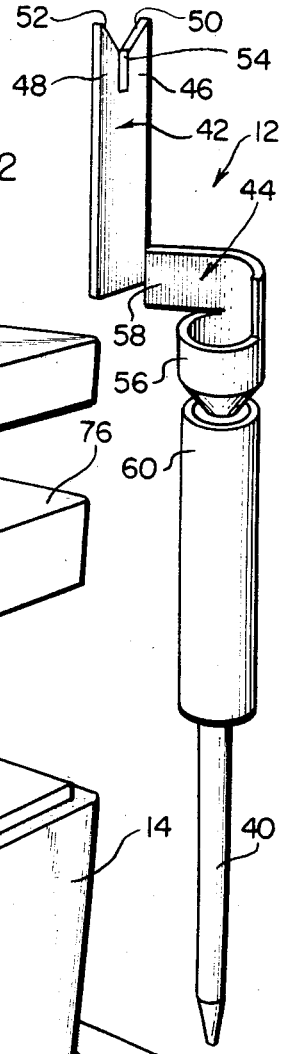
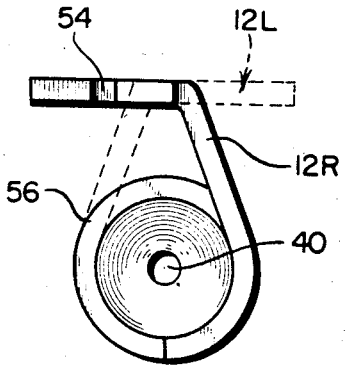
FIG. 3

FLAT CABLE CONNECTOR

BACKGROUND OF THE INVENTION

The present invention relates generally to electrical connectors and, more particularly, to a connector for making electrical connection between a cable having a plurality of conductors arranged in a first configuration and a second connector having a corresponding number of contacts arranged in a second configuration.

Flat ribbon-type cables are frequently used to interconnect circuit modules and the like, particularly in sophisticated electronic applications. Such cables generally comprise a plurality of parallel, side-by-side conductors, which may be either round or flat, and which are spaced apart from one another in a flat ribbon of insulating material. The insulating material is usually composed of a suitable flexible plastic, such as polyester, so that the conductors can be easily routed between the modules.

In order to take advantage of the many benefits realized by using flat cable, a connector is required for making electrical connection with the parallel conductors of the cable and for mating with a complementary connector installed, for example, on a circuit module or other electronic apparatus with which the flat cable is intended to be used. Connectors which have been developed for this purpose typically include a plurality of electrical contacts, each having a terminating portion for making electrical connection with one of the parallel conductors of the flat cable and a portion for mating with a complementary contact of the second connector. Electrical connection with the conductors is frequently achieved by using insulation displacement contacts which pierce the cable insulation to effect electrical contact with the conductors or by using various crimp-type terminations. U.S. Pat. No. 4,160,574 to DeRoss is exemplary of the insulation displacement technique.

A problem heretofore associated with the design and manufacture of connectors for use with flat cable is attributable to the fact that the standard conductor spacing of flat cable is normally different than the spacing of the contacts in standard connectors. For example, the conductors of one form of popular flat cable are spaced 0.050 inches apart while the contacts of a likewise popular connector are spaced 0.054 inches apart. Therefore, in order to use the standard flat cable with the standard connector, the flat cable connector must be capable of adapting the cable conductor spacing to the different spacing of the contacts of the standard connector with which it mates. Of course, the foregoing is of no particular concern where nonstandard connectors are used since the contacts of such connectors can be specifically designed to correspond to the conductor spacing of the flat cable. However, since economy normally dictates that standard components be used where possible, the use of nonstandard connectors is usually unacceptable.

Various flat cable connectors have been developed in the past which embody designs satisfying the foregoing adaptation function wherein the connector forms an appropriate interface between a flat cable whose conductors have a fixed spacing and a standard connector having contact spacing which is different than the spacing of the flat cable conductors. Typically, each contact of such flat cable connectors includes a contact mating portion and a conductor terminating portion offset therefrom by a precisely controlled amount. By suitably selecting the offset characterizing each contact, the connector may be constructed such that the mating ends portions of the contacts are arranged in a first configuration to mate with the contacts of the standard connector while the conductor terminating ends of the contacts are arranged in a second configuration for making electrical connection with the flat cable conductors. In one known prior connector of this type, every contact is specially designed and manufactured as a unique component characterized by its own particular offset relationship. Needless to say, this is a costly process and therefore not an altogether satisfactory solution to the problem.

In another known prior art technique, the conductor terminating end portion of each contact is connected to its associated contact mating end by a deformable intermediate portion. The contacts, which are formed with identical configurations, are inserted into a suitable housing where they are held in fixed positions with the mating ends of the contacts appropriately arranged for mating with the contacts of a corresponding standard connector. The contacts are then individually bent or deformed to align and space the conductor terminating ends for engaging respective ones of the flat cable conductors. In a subsequent operation, cover having a plurality of slots is installed on the connector body so that the conductor terminating end of each contact passes through a respective one of the slots. Electrical connection to a flat cable is then achieved by disposing the cable across the plate and applying downward pressure such that the conductor terminating end of each contact pierces the cable to make electrical connection with a corresponding one of the parallel conductors. Because this connector requires that the contacts be manipulated manually during its assembly, however, it is not an altogether satisfactory solution.

SUMMARY OF THE INVENTION

It is, therefore, a broad object of the present invention to provide a connector having a plurality of contacts for electrically connecting the contacts of a mating connector arranged in a first configuration to a plurality of conductors arranged in a second, different, configuration.

In the context of flat cable/connector interconnects, it is a primary object of the present invention to provide an improved, relatively inexpensive connector for mating a standard flat ribbon-type cable with a standard connector.

More specifically, it is an object of the invention to provide a connector of the foregoing type in which a plurality of identically configured contacts are used and in which the contacts are properly aligned for making electrical connection with the flat cable conductors in a novel and extremely cost effective manner that does not require each of the conductor terminating ends to be set manually.

These and other useful objects are satisfied by the connection apparatus of the present invention which includes a plurality of contacts having mating ends engageable with a set of contacts arranged in a first configuration and terminating ends adapted to be electrically connected to a corresponding plurality of conductors arranged in a second configuration, wherein housing means are provided for maintaining a first of the ends in a corresponding one of the configurations and alignment means cooperate with the housing means and a second of the ends to bring and maintain the second ends into the other of the configurations.

In a preferred embodiment of the invention, the apparatus comprises a connector adapted for interconnecting a flat ribbon-type cable to a complementary connector where the spacing of the cable conductors is different than the spacing of the contacts of the complementary connector. The connector comprises a plurality of substantially identical contacts, each having a conductor terminating end coupled to a contact mating end by an intermediate portion. The contacts are positioned in the connector so that the mating ends are arranged in a first configuration for mating with the contacts of the complementary connector. Thereafter, the conductor terminating ends of the contacts are caused to assume a second configuration, corresponding to the arrangement of the plurality of conductors, by installing a cover to the connector, the cover including a plurality of guide elements for deforming the contacts to align the conductor terminating ends of the contacts in the second configuration.

In the preferred embodiment, the guide elements of the cover comprise a plurality of tapered contact forming apertures terminating in a plurality of relatively small openings along the exterior surface of the cover. Upon installation of the cover to the connector, the conductor terminating end of each contact is guided into the enlarged entrance of a respective one of the contact forming apertures and exits through the relatively small exterior opening so that the contacts are suitably deformed to align and space the conductor terminating ends of the contacts for engaging the flat cable conductors.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the several figures and in which:

FIG. 1 is a perspective view, partially broken away, illustrating a connector constructed in accordance with the principles of the present invention;

FIG. 2 is an enlarged perspective view of an exemplary contact used with the connector of FIG. 1;

FIG. 3 is a top plan view of the contact shown in FIG. 2;

DESCRIPTION OF THE PREFERRED EMBODIMENT

Figure 5:
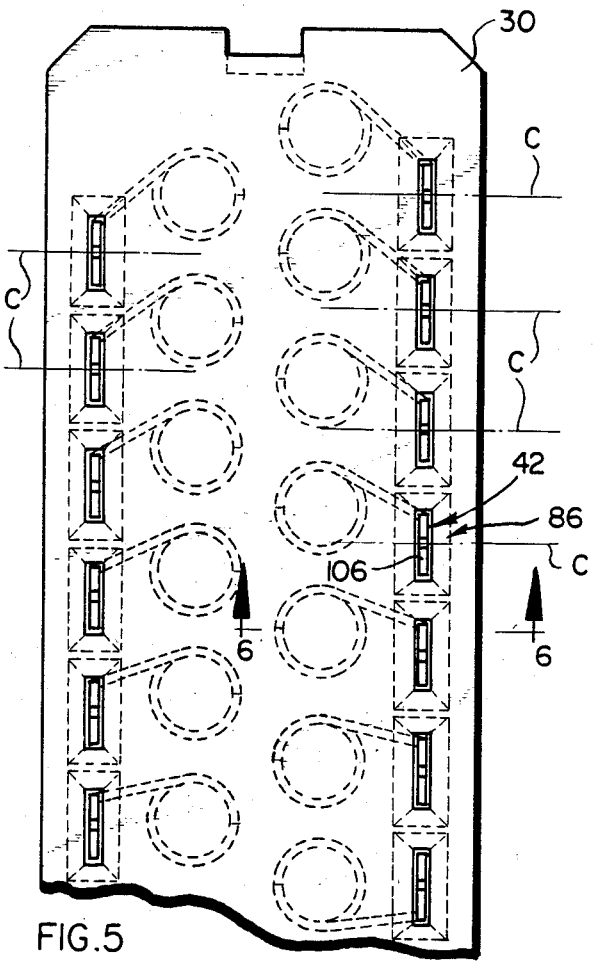
FIG. 5 is a partial top plan view of the connector after installation of the contact forming cover.

Referring now to FIG. 1 of the drawings, a connector constructed in accordance with the principles of the present invention 10 houses a plurality of contacts 12 therein for establishing electrical connections between the individual conductors of a standard flat ribbon-type cable and the corresponding contacts of a standard connector.

As illustrated in FIG. 1, connector 10 includes a two-piece shell comprising a rear shell portion 14 and a front shell portion 16. The rear shell portion is a generally rectangular, open-ended structure having a circumferential flange 18 at its forward end, while front shell portion 16 comprises a complementary piece also having a circumferential flange 20, but at its rearward end. Shell portions 14 and 16 are secured in abutting relation to complete the two-piece shell by a pair of circular lips 22 formed in flange 20 and swaged over flange 18. The resulting openings 24 thus provided on opposites sides of the shell permit mounting of the connector to a support structure, such as a panel, by means of suitable fasteners (not shown), whereby the shell is electrically grounded.

A front dielectric insert 26 and a center dielectric insert 28 are disposed within the shell, and a cover 30, which in the present embodiment is a rear dielectric insert, is disposed behind the center insert. Center insert 28, which together with front insert 26 is captured within the connector shell between rear insert 30 and an interior shoulder 32 of front shell portion 16, includes a plurality of bores 34 arranged in a pair of parallel rows with the bores of one row being staggered relative to the bores of the other row. Front insert 26 also includes a plurality of bores 36, each bore including a portion **36*a* having substantially the same diameter as bores 34, a narrowed portion 36*b* extending from portion 36*a* to the front of insert 26 and forming a shoulder 38 therebetween, and a countersunk portion 36*c*, which in the assembled connector, are disposed in coaxial relationship with bores 34 for receiving respective contacts 12**. Accordingly, the contacts are thereby arranged in a corresponding pair of rows with the contacts of one row being staggered relative to the contacts of the other row.

Referring now also to FIGS. 2 and 3, which illustrate the configuration of a representative one of contacts 12 prior to the installation of rear insert 30, it will be observed that each contact 12 includes a mating end 40 for engaging a complementary electrical contact, a terminating end 42 for making electrical connection to a corresponding conductor, and an intermediate portion, identified generally by reference numberal 44, offsetting the terminating end laterally with respect to the mating end and providing an electrical connection between ends 40 and 42. All of the contacts housed in the connector are identically configured except that some are left-handed and some are right-handed, a right-handed contact 12R being illustrated in solid lines in FIG. 3 and a corresponding left-handed contact 12L being illustrated in dotted lines. The conductor terminating end of each contact 12 projects beyond the rear insert 30 and preferably comprises an upstanding insulation displacement member of the type normally used with round conductor flat cables. Thus, each terminating end 42 conventionally comprises a pair of flanges 46 and 48 having opposed inclined insulation piercing surfaces 50 and 52, respectively, defining an elongated central slot 54 therebetween. At its base, the slot is somewhat smaller than the diameter of the round conductors of the cable. Consequently, when a conductor is pressed downward onto contact 12, the insulation is pierced by inclined surfaces 50 and 52, and the conductor is engaged and slightly deformed near the base of slot 54, insuring the development of a reliable electrical connection between the conductor and terminating end 42.

The insulation displacing conductor terminating end of each contact 12, in turn, is carried at the outer end of intermediate portion 44 which, as can be seen most clearly in FIG. 2 further comprises a bowl-shaped connecting portion 56 from which mating end 40 depends, and a flat blade portion 58 offsetting terminating end 42 laterally from mating end 40.

The particular connector shown in the present embodiment is a filter connector, and thus a tubular, ceramic capacitor 60 is mounted and electrically connected, for example, by soldering, to the upper portion of each contact mating end 40. In the assembled connector, each contact 12 is received in corresponding bores 34, 36 in front insert 26 and center insert 28 with the lower end of tubular capacitor 60 being supported by shoulder 38 and mating end 40 extending outwardly from narrowed bore portion **36*b*. Interposed between front insert 26 and center insert 28 is an electrically conductive grounding plate 62 having apertures 64 aligned with contact receiving bores 34, 36. A pair of tines, 66 and 68, depend from the grounding plate at each aperture 64 and extend into countersunk bore portion 36*c* to establish an electrical connection with an outer or ground electrode 70 of capacitor 60. A peripheral flange 72 of the grounding plate received in a circumferential notch 74 at the forward end of center insert 28 engages the shell to complete the electrical connection of electrode 70 to ground. As a result, each contact 12** is filtered to reduce undesirable EMI/RFI interference.

A cable clamp 76 and a strain relief clamp 78 are provided to facilitate the installation of the connector to the flat cable. More particularly, the cable clamp includes a plurality of positioning grooves 80 extending transversely along the interior surface of the clamp to facilite alignment of the conductors of the cable with the conductor terminating ends of contact 12. Cable clamp 76 further includes a pair of depending latch members 82 integrally formed with the clamp at its opposite ends. Each of the latch members terminates in an inwardly extending hook portion 84 which is adapted to snap-lock over a corresponding one of a pair of shoulders 86 formed at the opposite ends of rear insert 30 and secure the cable clamp to the connector, there by insuring that the electrical connections between the conductors and terminating ends 42 are maintained. A pair of longitudinally extending slots 88 and 90 are provided on the bottom surface of cable clamp 76 to provide clearance for terminating ends 42 of the contacts when the cable clamp is installed on the connector.

Strain relief clamp 78 also includes a pair of depending latch members 92 integrally formed with the clamp at its opposite ends. In a similar manner, each of the latch members terminates in an inwardly extending hook portion 94 for snap-locking over a corresponding one of a pair of shoulders 96 formed at the opposite ends of cable clamp 76, the terminated cable being looped back between strain relief clamp 78 and cable clamp 76 as is common practice.

As previously described, the spacing between the conductors of standard flat ribbon-type cable which the present connector is adapted to terminate is different than the spacing between contacts of standard connectors with which connector 10 is intended to mate. For example, in a standard connector having two parallel rows of contacts, adjacent contacts in each row are spaced apart by a distance of 0.108 inches, while adjacent conductors of a standard flat cable are spaced apart by a distance of 0.050 inches. Since the conductor terminating ends of the contacts of a flat cable connector are also typically arranged in two parallel rows, with adjacent ones in each row electrically engaging alternate conductors of the flat cable, the spacing between the contact mating ends (0.108 inches) and the conductor terminating ends (0.100 inches) of adjacent contacts in each contact row is different. The connector described herein is therefore designed to accommodate this spacing differential in a manner such that each contact 12 need not be uniquely configured. The foregoing is achieved in accordance with the present invention by locating contacts 12 such that the contact mating ends are properly configured for mating with the standard connector contacts and by the utilization of a cover, such as rear insert 30, having contact forming apertures 98 which, in cooperation with the connector housing the contacts, serves to properly align and space conductor terminating ends 42 simultaneously upon installation of the rear insert to the connector.

Figure 4:
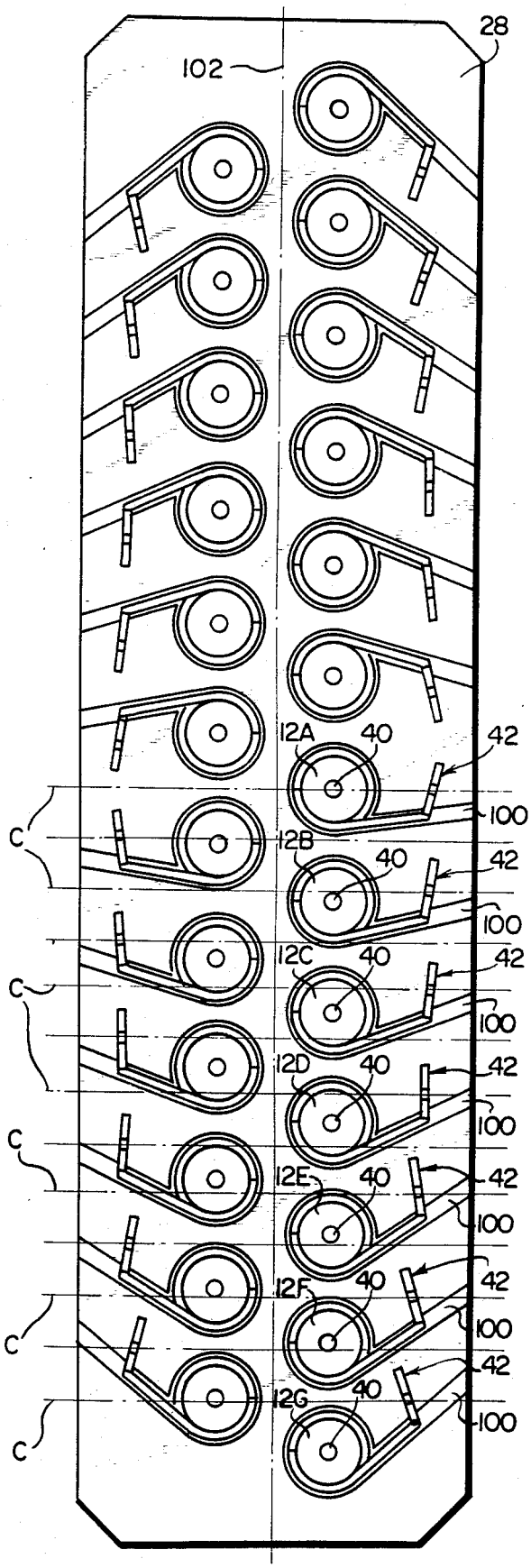
FIG. 4 is a top plan view of the connector prior to the installation of the contact forming cover.

Referring now to FIG. 4, which is a plan view of the connector with contacts 12 received in bores 34, 36 prior to the installation of rear insert 30, it will be noted that center insert 28 includes a plurality of keyways or contact positioning slots 100 formed in its rear surface, each slot 100 being adapted for receiving intermediate blade portion 58 of a respective one of the contacts. Each positioning slot 100 is angled relative to the longitudinal axis 102 of the connector with the degree of angularity progressively changing from the centermost slots to the outermost slots. For example, referring to the seven right-handed contacts 12A–12G in FIG. 4, the positioning slot receiving intermediate blade portion 58 of contact 12A forms nearly a 90° angle with the longitudinal axis of the connector while the angles formed between the positioning slots for contacts 12B–12G and the longitudinal axis progressively change in value with the maximum amount of change characterizing the positioning slot associated with contact 12G. As a result, when contacts 12 are received within the bores in inserts 26 and 28, intermediate blade portions 58 are seated in positioning slots 100 with the angles formed between conductor terminating ends 42 and the longitudinal axis of the connector progressively changing with adjacent contacts as shown. Similar angular relationships are established for the seven left-handed contacts in the same row of the connector as well as for the contacts in the bottom row of the connector.

In order to facilitate an understanding of the foregoing, a series of parallel dotted lines C are superimposed on the drawing of FIG. 4 to represent the position of the flat cable conductors to which the connector is to be installed. In this regard, it will be observed that the spacing between the contact mating end 40 of each contact 12 and the conductor C which the respective conductor terminating end is intended to electrically engage is different for each of the contacts. Thus, while this spacing is minimal for contact 12A, it progressively increases for contacts 12B through 12G with contact 12G being characterized by maximum spacing. To account for this spacing variance, positioning slots 100 serve to orient the contacts such that contact mating ends 40 are aligned for mating with a standard connector while conductor terminating ends 42 each form a selected angle with longitudinal axis 102 such that terminating end slots 54 are nearly in alignment with their respective conductors C. Thus, while conductor terminating portions 42 are at different angles with respect to longitudinal axis 102, slots 54 are properly spaced for making electrical connection with the flat cable conductors.

Figure 6:
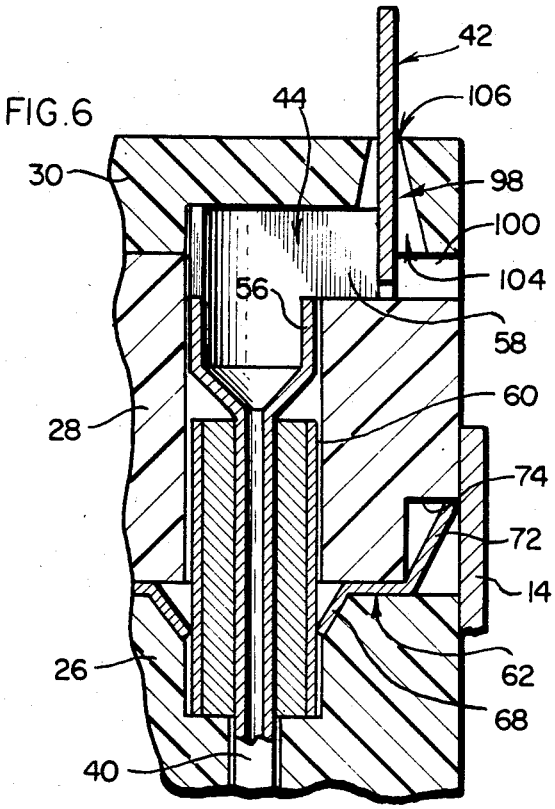
FIG. 6 is a sectional view taken along line 6—6 in FIG. 5.

After the contacts have been positioned in the connector as illustrated in FIG. 4, rear insert 30 is installed on the connector, as illustrated in FIGS. 5 and 6, to align the conductor terminating ends of contacts 12 parallel to longitudinal axis 102. More specifically, rear insert 30 includes two staggered rows of longitudinally aligned contact forming apertures 98 adapted for receiving the conductor terminating end of respective ones of the contacts. Each aperture 98 can be best described as being a truncated pyramidal aperture having an enlarged entrance opening 104 at the interior surface of rear insert 30 and tapering to a narrowed exit opening 106 at the exterior surface of the rear insert substantially conforming to the dimensions of the conductor terminating end.

Upon installation of rear insert 30 to connector 10, the conductor terminating end of each contact 12 enters the enlarged entrance opening of its associated aperture 98, is guided upward by the tapered walls of the aperture and passes through the exit opening of the aperture as rear insert 30 is forced downward into abutment with center insert 28. As each conductor terminating end 42 is guided upwardly through its associated aperture 98, a forming operation is simultaneously effected on all the contacts, the conductor terminating end of each contact 12 being bent or displaced with respect to its intermediate portion 44 at the juncture therebetween such that the conductor terminating ends in each row are aligned longitudinally. The degree of forming is, of course, different for each contact 12 with, for example, contacts 12A and 12G undergoing the maximum forming. Since the conductor terminating end of contact 12D is already substantially in longitudinal alignment prior to the installation of rear insert 30, this contact is subjected to essentially no forming. It will thus be appreciated that the forming operation, comprising the installation of rear insert 30, displaces of the conductor terminating ends of contacts 12 through respective arcs, each centered at the junction between a respective conductor terminating end and its associated intermediate portion. As a result, the conductor terminating ends of contacts 12 are brought into and maintained in longitudinal alignment, and slots 54 of the terminating ends are suitably spaced for engaging the conductors of the flat cable. Accordingly, in the present embodiment, the center slots of adjacent conductor terminating ends 42 will be spaced 0.100 inches apart, corresponding to the flat cable conductor spacing, while the contact mating ends of the contacts will be spaced 0.108 inches apart, corresponding to the spacing of the contacts of a standard connector.

After the forming operation described above has been completed, the connector is ready for installation to a standard flat cable. In installing the connector to the flat cable, the cable is first laid across cable clamp 76 and there looped under the clamp, the parallel positioning grooves 80 cooperating with the longitudinally ribbed cable insulation to align each conductor in registration with a respective one of the conductor terminating ends of contacts 12. Cable clamp 76 is next locked to rear insert 30, forcing the cable conductors downwardly upon the protruding conductor terminating ends so that each of the contacts electrically engages one of the conductors. Finally, strain relief clamp 78 is then latched to cable clamp 76 to securely hold the cable therebetween and provide strain relief.

What has thus been shown is an improved connector comprising a plurality of substantially identically configured contacts which are individually and simultaneously formed by installing a cover to the connector. As a result, an inexpensively manufactured and assembled connector is provided which is capable of interfacing between a standard flat ribbon-type cable and a standard connector having contacts spaced differently than the spacing of the cable conductors.

Although in the embodiment just described the conductor terminating ends of the contacts are thereby longitudinally aligned and appropriately spaced for electrically engaging the conductors of a flat cable, it will be apparent that the contact mating ends can be formed in a manner consistent with the principles of the present invention to also accomplish the objects thereof.

Accordingly, while a particular embodiment of the present invention has been shown and described, it will be apparent that changes and modifications may be made therein without departing from the invention in its broader aspects. The aim of the appended claims, therefore, is to cover all such changes and modifications as fall within the true spirit and scope of the invention.

What is claimed is:

1. A connector for making electrical contact with each of a plurality of parallel conductors spaced from each other by a first predetermined distance comprising:

a plurality of substantially identical contacts, each comprising a conductor terminating end adapted for making electrical connection with one of said conductors, a contact mating end and a deformable intermediate portion connecting said conductor terminating end and said contact mating end;

a shell;

at least one dielectric insert housed within said shell and having bores holding said contacts, said contact mating ends being held by said bores in a row and spaced from each other by a second predetermined distance different than said first predetermined distance, said dielectric insert further having slots for receiving said deformable intermediate portions of said contacts and positioning said contacts such that said conductor terminating ends are disposed in a row and spaced from each other by said first predetermined distance; and a rear dielectric insert having a plurality of tapered contact forming apertures aligned in a row, said rear dielectric insert being installable on said connector with one side thereof disposed adjacent said one dielectric insert such that the conductor terminating end of each of said contacts is guided through a respective one of said contact forming apertures to deform the intermediate portions of at least some of said plurality of contacts and align said conductor terminating ends in a row and spaced from each other by said first predetermined distance.

2. The connector of claim 1 wherein each of said contact forming apertures comprises a truncated generally pyramidal shaped aperture having an enlarged entrance opening on the side of said rear dielectric insert disposed adjacent said one dielectric insert and narrower exit opening on the opposite side of said rear dielectric insert, the dimensions of said exit openings being substantially equal to the dimensions of said conductor terminating ends.

3. The connector of claim 2 including a capacitor mounted on each of said contacts.

4. The connector of claim 1 wherein said dielectric insert housed within said shell comprises a front dielectric insert having said bores and a rear dielectric insert having said slots.

5. The connector of claim 1 wherein each of said contact forming apertures comprises a truncated generally pyramidal shaped aperture.

6. The connector of claim 1 including cable clamp means for clamping a cable which includes said plurality of parallel conductors.

7. The connector of claim 6 including strain relief means for relieving strain on said cable.

8. The connector of claim 7 wherein said cable comprises a flat ribbon cable.

9. The connector of claim 1 including capacitor means associated with said contacts.

* * * * *